United States Patent [19]

Flatau et al.

[11] 3,951,070

[45] *Apr. 20, 1976

[54] NON-HAZARDOUS RING AIRFOIL PROJECTILE OF NON-LETHAL MATERIAL

[76] Inventors: Abraham Flatau, 2003 Stockton Road, Joppa, Md. 21085; Donald N. Olson, 38 Atherton Road, Lutherville, Md. 21093; Miles C. Miller, 504 Haverhill Road, Joppa, Md. 21085

[ * ] Notice: The portion of the term of this patent subsequent to Aug. 12, 1992, has been disclaimed.

[22] Filed: Dec. 6, 1973

[21] Appl. No.: 422,493

Related U.S. Application Data

[63] Continuation-in-part of Ser. No. 310,626, Nov. 29, 1972, Pat. No. 3,898,932.

[52] U.S. Cl. ..... 102/92.4; 102/92.1; 102/92.7

[51] Int. Cl.[2] ..... F42B 13/46; F42B 11/32

[58] Field of Search ..... 102/91, 92.1, 92.2, 102/92.3, 92.4, 92.7, 92.6, 93, 42 C, 65.2

[56] References Cited

UNITED STATES PATENTS

| | | | |
|---|---|---|---|
| 3,074,344 | 1/1963 | Devaux | 102/42 C |
| 3,170,405 | 2/1965 | Jungermann et al. | 102/91 |
| 3,311,061 | 3/1967 | Roehrdanz | 102/93 |
| 3,318,033 | 5/1967 | Barr | 102/65.2 X |
| 3,738,271 | 6/1973 | La Costa | 102/65.2 X |

FOREIGN PATENTS OR APPLICATIONS

| | | | |
|---|---|---|---|
| 1,054,077 | 11/1963 | United Kingdom | 102/64 |

*Primary Examiner*—Charles T. Jordan
*Attorney, Agent, or Firm*—Nathan Edelberg; Robert P. Gibson; Robert W. Church

[57] ABSTRACT

A rotatable airfoil projectile comprising a hollow closed circular ring wing surrounding a central open area with a non-lethal riot control agent positioned within the hollow ring. The projectile consists of an aerodynamic lifting body of a thick ring wing geometry which uses spin imparted to it from a launching means for its gyroscopic stability. The combination of aerodynamic stability characteristics and high spin rate (i.e. above 2,000 rmp) results in a flat trajectory and extended range capability.

The projectile ruptures on impact due to centrifugal and impact forces to distribute the non-lethal riot control payload about the target area. The sub-sonic launch velocity avoids bodily harm due to impact with a person even at point-blank range.

19 Claims, 15 Drawing Figures

NON-HAZARDOUS RING AIRFOIL PROJECTILE OF NON-LETHAL MATERIAL

This application is a continuation-in-part of Ser. No. 310,626, filed Nov. 29, 1972, now U.S. Pat. No. 3,898,932.

The invention described herein may be manufactured, used or licensed by or for the government for governmental purposes without payment to us of any royalty thereon.

Briefly stated, the present invention relates to a non-lethal ring airfoil projectile for use in pacifying or dispersing unruly persons (such as, for example, mobs).

The wide spread mob violence of recent years has spurred the development of numerous mob control devices, including notably rifle-fired tear gas grenades and other types of projectiles and also various hand-held weapons for use by military and civil police to control mob violence. Desirably the authorities should be equipped with projectile means to disperse or control mobs without killing, disfiguring or permanently injuring any members thereof.

Unfortunately, the mob control devices of a projectile nature proposed heretofore suffer from certain serious disadvantages. If fired from too close, e.g. point blank, the projectile can cause serious injury to a target individual. On the other hand, the usual mob control projectile (as for example, a tear gas grenade) is not very accurate when fired from a distance great enough for the policeman to be out of range of injurious objects such as rocks which might be hurled by rioters.

It has now been discovered that the ring airfoil munition disclosed in copending application of A. Flatau, Ser. No. 272,252, filed 17 July 1972, now U.S. Pat. No. 3,877,383, which in turn is a CIP of Ser. No. 105,751, filed Jan., 1971, and now abandoned is well adapted to mob control, particularly if modified into the structure of the present invention.

The munition projectile comprises a ring airfoil or ring wing, i.e. a body of revolution generated by an airfoil cross-section rotated 360° about an axis beneath and parallel to the longitudinal direction of the airfoil cross-section. The hollow region internally of the ring wing houses the payload and explosive train. In particular, the munition projectile of the aforementioned copending application comprises an aerodynamic lifting body of a thick ring wing geometry which utilizes a spin in excess of about 2,000 rpm imparted thereto by the launching means for gyroscopic stability. Normally this projectile has a near neutral static stability and associated aerodynamic performance characteristics which provide predictable repeatable trajectories and extended range. These aerodynamic characteristics are based on the generation of a lift force, as gravity tends to pull the projectile downward, and the low drag shaping. To provide for payload capacity, the wing cross-section should exceed 25% of the chordal dimensions.

Important to use of a ring airfoil projectile for mob control purposes is its relatively low launching velocity, being always launched at a subsonic velocity, e.g. below about 300 ft/sec. Low launch velocity and an extended range are desired attributes for a mob control device which will not cause lethal injury on impact of the human body at point blank range, yet be capable of launch from a distance far enough to be out of the rock-throwing range of rioters, e.g. 50 to 100 meters.

The principal object of the present invention is to provide a projectile containing a riot control payload which will not cause lethal injury upon impact with the human body due to kinetic energy even at the point blank range.

Another object of the present invention is to provide a projectile containing a mob control payload, capable of being launched accurately from a distance.

A further object of this invention is to provide a frangible ring airfoil which produces a high degree of payload dissemination at a target area.

Still other objects of the invention and advantages thereof will become apparent from the detailed description thereof hereinafter set forth.

Briefly stated, the ring airfoil projectile of the present invention is a relatively thick ring wing. A non-lethal payload is to be carried inside the ring air foil and the materials and structure of the ring airfoil are such that the ring airfoil is frangible, rupturing on impact. The ring airfoil wing material is stressed by the forces involved with its launch spin to very near the rupture point; the additional forces applied by impact then cause rupture, releasing the payload.

For a more detailed description of this invention and disclosure of the preferred embodiments thereof, reference is now made to the attached drawing wherein.

Figure 1:
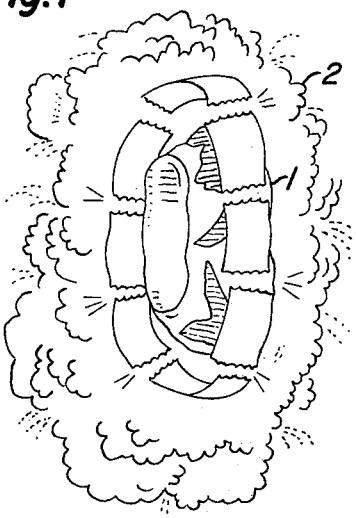
FIG. 1 is a diagrammatic view showing the rupture of the ring airfoil projectile.

As shown in FIG. 1, the frangible ring airfoil 1 is adapted to fragment or rupture upon impact, releasing its payload 2 into the impact area. By the use of the term "frangible" applicants use it in a general sense at impact. That is, at impact it comprehends the rupturing and the inelastic character of the projectile portion and/or break band to destroy the projectile integrity and cause proper payload dissemination. The ring airfoil 1 (FIGS. 4–15) is a ring with an inner wall 3 and an outer wall 4 joined at leading edge 5 and trailing edge 6 with space between walls for payload 2. Walls 3 and 4 are, of course, contoured to be airfoil shapes and together have a thickness to chord ratio in excess of 20%. The diametric extents of our ring airfoil shape are defined by the exposed surfaces of walls 3 and 4 and when used the band 14 which overlays wall 4. Leading edge 5 and trailing edge 6 define the longitudinal extent of our projectile.

Since a principal object of the present invention is to provide a non-lethal launched (rather than thrown or hurled) projectile, the material used for the ring air foil should be particularly light weight, even soft, such as plastics, rubber, etc. Flexible light weight plastics are known to the art and, therefore, the actual materials from which the projectile is fabricated form no part of the present invention. In addition, thin wall sections or pre-weakened wall portions, particularly in outer wall 4, may be employed to facilitate rupture upon impact. Such expedients are too well known for detailed discussions thereon. Illustrated by the drawing is a preferred construction of the ring airfoil projectile intended to insure rupture on impact, yet permit relatively rough handling without rupture prior to launch. Since the ring airfoil projectile is a low velocity device with a subsonic launch velocity usually not exceeding about 300 ft/sec., frangibility can be assured by relating high spin to wall strength. Centrifugal force due to spin loads the wing wall very close to its rupture point. Thereafter, even a soft impact will increase wall stresses beyond the rupture point.

Figure 2:
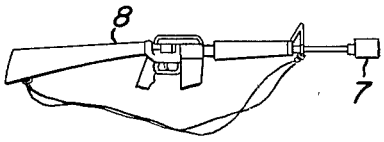
FIG. 2 is a diagrammatic view showing a weapon adapter attached to the muzzle of a rifle.

It may be noted that mechanical launch means such as a rifle and adapter 7 (FIG. 2) are capable of imparting spin in excess of 2,000 rpms, normally 4,000–6,000 rpms. Spin stressing the wing wall offers several safety features. The ring wing material can be made strong enough for safe handling, even mishandling without rupture. Also, in the event any ring airfoil projectile does land without rupture and payload release and is then hurled back by a rioter, it will not normally rupture or fragment upon impact (for lack of prestressing through spin). Although a rifle launch means has been illustrated, the projectile could be fired from a pistol adapter or a special hand-held weapon designed for this non-lethal use only.

The importance of non-lethality makes the preferred size range for the non-lethal air foil of the present invention surprisingly narrow, i.e. 2–3 inch diameter. The minimum projectile should be too large to impact principally in someone's eye, yet the largest projectile should be small enough so that its impact energy will not crush the face.

Figure 3:
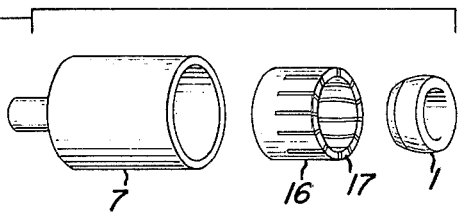
FIG. 3 is an exploded view showing a weapon adapter to eject the projectile from the weapon, a sabot and the projectile.
Figure 4:
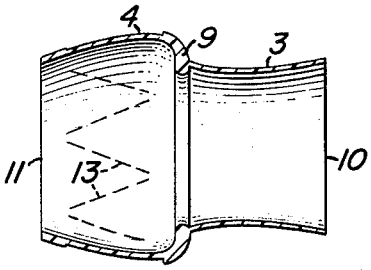
FIG. 4 is a view of a preferred mode of projectile showing the projectile body with the inner wall extended.
Figure 5:
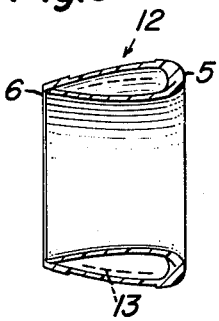
FIG. 5 is a fragmentary view of the projectile.
Figure 6:
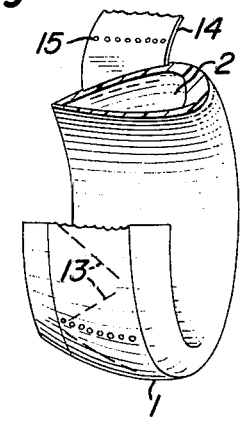
FIG. 6 is a cut-away view of the projectile mode of FIG. 4 showing a break band, slits in the outer wall and internal configuration.

A desirable attribute of the non-lethal ring air foil projectile of the present invention is that accuracy and a relatively extended range are combined with the relatively low launch velocity of below about 300 ft/sec., preferably about 250–300 ft/sec. The ring airfoil porjectile launched from a rifle mounted adapter 7 (see FIGS. 2,3) is accurate to about 100 meters or yards. As compared to tear gas grenades, the ring airfoil has the advantage of a relatively flat trajectory.

In the embodiment already discussed, the frangible ring airfoil 1 is an envelope-type container fabricated of a soft and resilient material such as soft rubber or plastic. Inner wall 3 is formed (e.g. molded) integral with outer wall 4 joined by shoulder 9. Inner wall 3 nests within outer wall 4, with the edge 10 of inner wall 3 being heat sealable in conventional manner to the edge 11 of outer wall 4 after a payload 2 is loaded between inner wall 3 and outer wall 4 to form trailing edge 6. The ring airfoil projectile structure illustrated is a modified Clark-Y airfoil. The ring wing is thick, made so by blending two air foils having different thicknesses to chord ratios in back-to-back relationship. Their respective thickness to chord ratios is nominally 22% and 11% and the resultant ring airfoil having a thickness to chord ratio of 28.5%. However, other back-to-back air foil cross-sections are contemplated as being within the scope of this invention so long as such other ring wings have a nominal thickness to chord cross-section ratio of at least 20%.

The payload, which may be any material adequate to meet the requirements of the intended non-lethal given applications (such as powder, liquid, encapsulated gels or liquids, and pelletized lacriminatory materials) can be loaded between walls 3 and 4 by conventional filling and dispensing apparatus in conventional manner prior to sealing off trailing edge 6.

The recess 12 is formed in outer wall 4 (by conventional molding techniques) and slits 13 are formed in outer wall 4 in a non-continuous saw-tooth slit line configuration (by conventional die cutting techniques). A resilient break band 14 of a flexible material, which has a low elongation under load, has perforations 15 formed therein (by conventional perforation means). Band 14 is mounted adhesively within recess 12 with each line of perforation 15 set so one end thereof coincides with the intersection of two lines of slits 13 at border of recess 12; the opposite end of the line of perforations 15 then becomes located one-half way between a pair of intersecting lines of slits 13 at the opposite border of recess 12 (as may be seen in FIG. 7). The band 14, which is added before introducing payload 2, prevents the opening of slits 13 during introduction of the payload 2 within the projectile 1, during storage, shipping and handling of the loaded projectile, and even during its flight prior to impact with the target.

Perforations 15 control the strength of break band 14 so that centrifugal force loads due to spin in flight (in excess of 2,000 rpm) preload break band 14 to near structural failure so that break band 14 will be deformed and open on impact with the target (as shown in FIG. 1), disseminating the payload at a target area.

Figures 9, 10, 11, 12, 13, 14, 15:
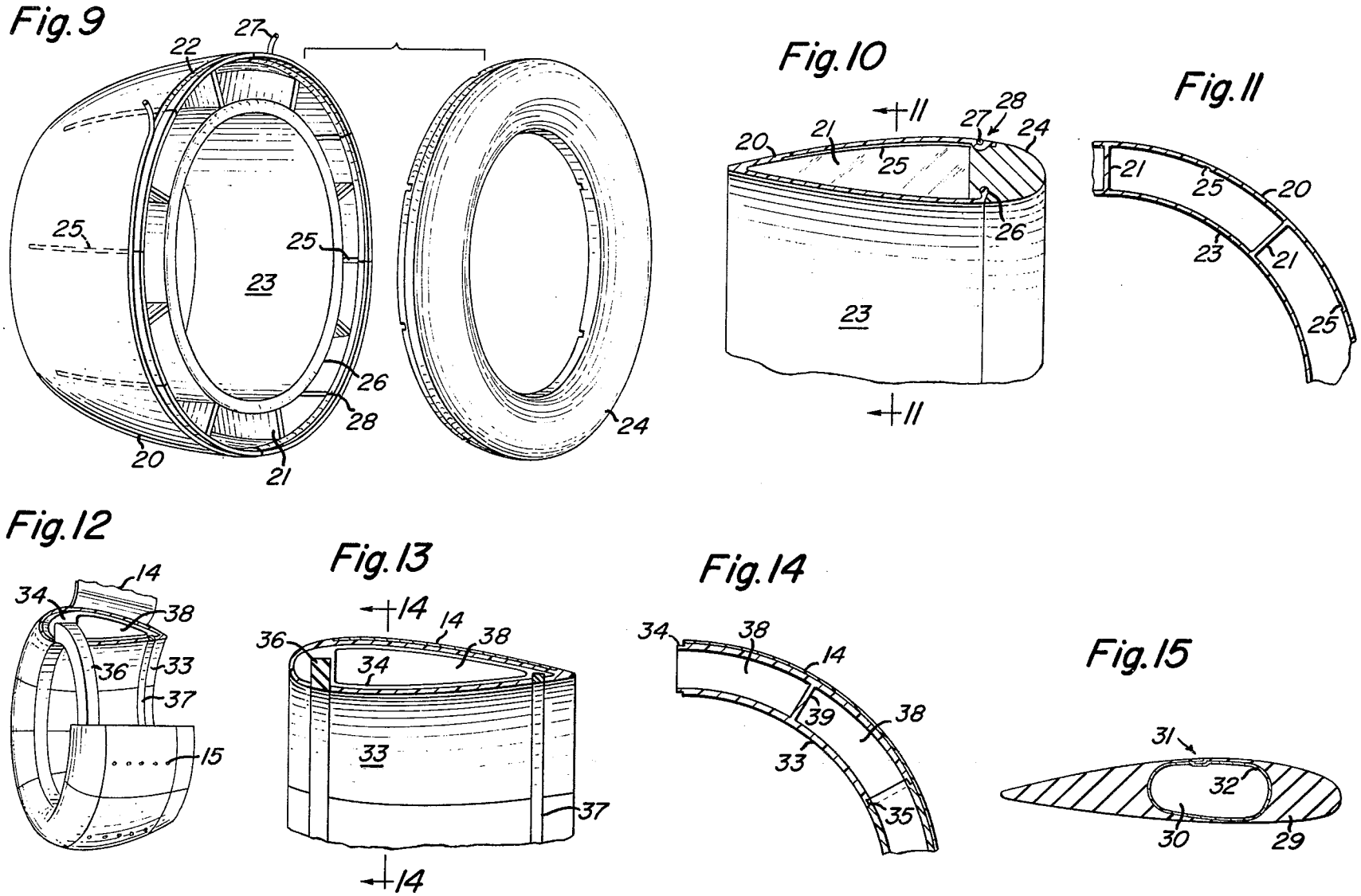
FIG. 9 is a diagrammatic view of a two-piece mode of projectile.
FIG. 10 is a partial cross-section of an assembled projectile according to the mode of FIG. 9.
FIG. 11 is an enlarged fragmentary partial cross-section taken along the line 11 of FIG. 10.
FIG. 12 is broken away diagrammatic view of a segment mode of projectile.
FIG. 13 is a partial cross-section of the segment mode projectile of FIG. 12.
FIG. 14 is a partial cross-section taken along line 14—14 of FIG. 13 showing one segment, and part of another segment.
FIG. 15 is a partial cross-section of a one piece mode of projectile.

A different one piece mode of projectile is illustrated in FIG. 15. The leading edge and trailing edge of projectile 29 are solid, e.g. foam, and a toroidal cavity 30 is left at the center of the ring airfoil. Separated, thin outer flaps 31 expose cavity 30 for filling with payload. In the mode illustrated by FIG. 15, the payload is prefilled in a frangible toroidal bag 32. After filling, flaps 31 may be adhesively joined, and if desired (not shown) a break band may be wrapped around airfoil projectile 29, hiding the joint between flaps 31. In any event projectile 29 is constructed to fail upon impact at the juncture of flaps 31, releasing the payload.

Other methods of slitting the outer walls to form a plurality of small flaps which are held shut by the breakband are contemplated. The same applies to breakbands of materials such as paper which may or may not be weakened by perforations, being rather of overall controlled strength.

One advantage of the projectile mode of FIG. 15 is that the same molded product can also constitute a kinetic energy non-lethal projectile according to the principles of copending application Ser. No. 310,625, filed Nov. 29, 1972. For such purposes, the cavity 30 would normally be filled with a light weight (foamed) material and flaps 31 adhesively joined thereto.

FIGS. 9, 10, and 11 illustrate a two piece mode of projectile containing multiple compartments for containing riot control agent.

The compartmentalized version of the projectile, illustrated in FIGS. 9, 10 and 11, is molded in two pieces. In the aft section, an outer wall 20, inner wall 23 and partitions 21 are integrally molded together. The nose or forward section 24 is molded separately. This divides the interior of the projectile into eight equal compartments which assures a more uniform distribution of the payload for better gyroscopic balance and a sturdier structure for surviving set back and spin acceleration forces at launch. On assembly of the projectile, the compartments would be filled before the nose 24 would be attached to the aft end. A mechanical lock 26 firmly secures inner wall 23 to nose 24. Outer wall 20 is secured to nose 24 by a tight fitting band or cord 27 (shown in FIG. 9). Cord or band 27 fits into groove 22. Cord or band 27 is a break band designed so that spin forces in flight pre-load it to near mechanical failure. In addition, the wall 20 may be thinned at 25 or otherwise weakened in such a way as to tear more easily than the rest of the wall. This weak point 25 is illustrated as being midway between the partitions. However, it can be located elsewhere if it proves to be advantageous to do so. This weakened part of the structure 25 would be designed so that when break band 27 fails due to target impact, the payload bearing against wall 20 will cause tearing along 25. In addition, or alternatively, the slit and break band may be present as in the projectile design embodied in FIG. 7.

FIGS. 12, 13 and 14 illustrate a segmented version of the projectile. Six segments are shown in FIG. 12 (of which there would be eight). The segments fit together using a rabbet joint where the rabbet protrusion 34 in one segments fits into the rabbet recess 35 in the adjacent segment. A ring 36 near the forward part of the projectile and a ring 37 near the aft part of the projectile are shown in section in FIG. 13. These rings align the segments 33 with respect to each other. Ring 36 is made of a heavier, though relatively soft, materiel than segment 33 for proper location of the center of gravity of the projectile. When the segments 33 are assembled with rings 36 and 37, a break band 14 similar to the one shown in FIG. 6 with perforations 15 holds the assembled segments and rings together and functions, in flight and on impact with a target, in the same manner as it does for the projectile shown in FIG. 6. Cavity 38 holds the riot control agent. Partition 39, shown in section view of FIG. 14, separates the payload for better weight distribution in flight. Partition 39 is shown centrally located in the segment; however, it can be located elsewhere such as at the rabbet protrusion 34. On impact with a target, the break band 14 fails and the segments 33 are separated from the rings 36 and 37 so that the payload is free to escape from the segments through the open ends of the segments 33.

Partition 39, which may be a separate piece in each segment that fits in the rabbet recesses 35 when the segments are joined together, can be inserted in place to form rabbet protrusion 34 in a segment 33 and mounted on ring 36. The cavity 38 of the segment is filled with riot control agent. Then another partition 39 is placed in the recess 35 through which the cavity 38 was filled, thus sealing the segment. Then the next segment is placed on top of the previously filled segment and the assembly is rotated so that the second segment is sealed with a partition and the segment number three is placed on top of segment number two and the assembly is rotated until segment number three can be filled and sealed, ultimately all segments are assembled and filled to form a closed ring. After this, break band 14 is put on and the entire projectile is prepared for launching.

The principal advantages of the segmented design are the ease with which the parts can be molded with provision for partitions, the positive functioning of such a design at impact when the break band fails and the potentially greater dissemination efficiency, regardless of mode of impact since each segment will be completely open at each end.

The segment mode of FIGS. 9, 10 and 11 and the multiple compartment modes of FIGS. 12, 13 and 14 subdivide the payload of the projectile so that shipment vibrations and storage cannot create a concentrated void space and packed load region, with a resulting aerodynamic instability of the projectile.

When the ring airfoil projectile is launched from an adapter 7 attached to a weapon 8, e.g. a rifle, propulsion forces cause the sabot 16 to separate from adapter 7, releasing the ring airfoil into its relatively flat trajectory. Sabot 16 is fabricated from a lightweight (foam) material with a plurality of fingers 17 formed therein. Fingers 17 are torn away from base 18 of sabot 16 at undercut 19 in flight by centrifugal force to permit projectile 1 to separate in flight from sabot 16. Adapter 7 will normally be designed to impart the desired spin rate to the projectile. Sabot 16 breaks into a plurality of pieces, slows rapidly and drops to the ground almost immediately. In place of sabot 16, a captured sabot that is retained by the launcher/adapter during projectile launch may be incorporated. This would limit the objects exiting from the muzzle of the launcher/adapter to the projectile itself.

Figure 7:
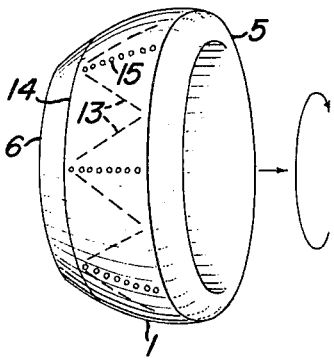
FIG. 7 is a view of the mode of FIG. 6 showing the completed projectile and the projectile in the direction of flight and the sense of rotation in flight.
Figure 8:
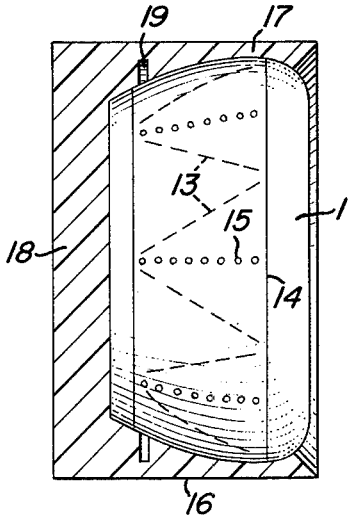
FIG. 8 is a view showing the projectile mounted in the sabot for ejection from a weapon.

Desirably in the mode of FIG. 1, the projectile wall is thickened and shaped to form a shoulder 9 at the point of intersection of inner wall 3 and outer wall 4 with enough weight of material to act as ballast for center of gravity control for the ring airfoil. The ballast is built into the other projectile modes illustrated in the drawing. In flight, the projectile flies in an attitude with rounded edge portion 5 leading, feathered edge portion 6 trailing, and the projectile rotating in a clockwise direction, as shown in FIG. 7. The smooth low drag airfoil shaping minimizes velocity decay and spin decay of the projectile in flight conserving the launch-imparted kinetic energy and centrifugal forces. Thus, impact at short or nominal ranges, e.g. 30–100 meters creates a large and rapid increase in the circumferential loading on the projectile, e.g. on band 14, at one or more of the rows of perforations 15 in the break band, in sufficient excess of the load already imposed on it by centrifugal forces to break the band 14 completely at one or more of these rows of perforations. Immediately, the full centrifugal force of the payload bears against the outer wall 4 of the projectile 1 so that the dashed slits 13 structurally fail, deform and open up, or a plurality of flaps open up, releasing the payload 2 as shown in FIG. 1. The high tangential velocity of the individual payload particles (due to the high spin rate of the projectile) disperses the payload into a cloud in the target area upon release from the ruptured projectile.

The low drag, flat trajectory due to lift, and accuracy of the ring airfoil projectile enables it to be aimed and fired at a point target from a distance so that only that amount of payload needed to expose a point target to the effects of the payload agent need be delivered thereto. This eliminates the necessity to contaminate a large area in order to assure that a point target is exposed to the payload agent. For example, the ring airfoil projectile can be fired into a window from about 100 meters or to hit a specific individual at 30–50 meters.

What is claimed:

1. A non-lethal projectile comprising: an annular ring shaped, closed structure having a substantial tear drop airfoil cross-section; said structure being of substantially resilient material and defined externally by major annular inner and outer surfaces defining the diametric extent of said structure, and being terminated by leading and trailing edges defining the longitudinal extent of said structure; said structure defining at least one hollow portion therein; an incapacitating agent payload disposed within said hollow portion; and a rupturable portion on the exterior of said structure.

2. The invention of claim 1 wherein said projectile includes a band means as a part of said rupturable portion on the exterior of said structure.

3. The invention of claim 2 wherein said band means is wrapped around said structure.

4. The invention of claim 1 wherein the rupturable portion comprises an annular relief portion of the structure adapted to receive rupturable band means.

5. The invention of claim 4 wherein the bottom of the relief portion is weakened for impact rupture.

6. The invention of claim 1 wherein the rupturable portion comprises an annular relief portion of the structure overlayed with a wrapped band.

7. The invention of claim 6 wherein said relief portion and said wrapped band are weakened for impact rupture.

8. The invention of claim 1 wherein said structure comprises portions forming said outer and inner diametric extents which are of resilient material and connected at at least one edge portion.

9. The invention of claim 8 wherein said structure is closed at an edge portion.

10. The invention of claim 1 wherein said structure comprises resilient material of foam forming the longitudinal extents of said projectile.

11. The invention of claim 1 wherein the said at least one hollow portion is filled with a payload inclosed in bag means.

12. The invention of claim 1 wherein said structure includes plural internal partitions forming plural payload receiving hollow portions.

13. The invention of claim 12 wherein the structure includes an aft section forming the inner and outer diametrical extents of said projectile spaced by partitions and the trailing edge thereof, and a mechanical locking forward section which forms the leading edge of the projectile structure.

14. The invention of claim 12 wherein the structure includes plural hollow airfoil shape segments mechanically locked together and held in proper relation by ring means.

15. A non-lethal projectile structure comprising: an annular ring shaped structure of substantial tear drop airfoil cross-section, said structure being of substantially resilient material and defined externally by major annular inner and outer surfaces defining the diametric extent of said structure, and being terminated by leading and trailing edges defining the longitudinal extent of said structure and said structure defining at least one hollow portion therein which is externally accessible at impact.

16. The invention of claim 15 wherein said at least one hollow portion is adopted to be accessible at an annular recess.

17. The invention of claim 16 wherein said recess has slits on the bottom thereof.

18. The invention of claim 16 wherein the recess is overlayed with band means.

19. The invention of claim 17 wherein the recess is overlayed with band means.

* * * * *